US007637223B2

(12) United States Patent
MacDonald et al.

(10) Patent No.: US 7,637,223 B2
(45) Date of Patent: Dec. 29, 2009

(54) APPARATUS AND METHOD FOR TRANSPORTING A VESSEL

(76) Inventors: Donald James MacDonald, 23881-119A Avenue, Maple Ridge (CA) V4R 1W3; David John Moore, 26564-110$_{th}$ Avenue, Maple Ridge (CA) V2W 1S5

( * ) Notice: Subject to any disclaimer, the term of this patent is extended or adjusted under 35 U.S.C. 154(b) by 0 days.

(21) Appl. No.: 11/501,310

(22) Filed: Aug. 8, 2006

(65) Prior Publication Data

US 2008/0035045 A1 Feb. 14, 2008

(51) Int. Cl.
*B60P 3/10* (2006.01)

(52) U.S. Cl. ..... 114/344

(58) Field of Classification Search ..... 114/344; 280/47.331

See application file for complete search history.

(56) References Cited

U.S. PATENT DOCUMENTS

| | | | | | |
|---|---|---|---|---|---|
| 3,671,056 | A | | 6/1972 | Windemuth | |
| 3,687,476 | A | | 8/1972 | Abbott | |
| 3,917,083 | A | * | 11/1975 | Cam | 414/391 |
| 4,822,065 | A | * | 4/1989 | Enders | 280/47.331 |
| 5,261,680 | A | * | 11/1993 | Freitus et al. | 280/47.331 |
| 5,330,212 | A | * | 7/1994 | Gardner | 280/40 |
| 6,189,478 | B1 | * | 2/2001 | Myers et al. | 114/344 |
| 6,446,570 | B1 | | 9/2002 | Johnson | |

OTHER PUBLICATIONS

Trail Tamer Wheel Assembly with Aluminum Wheel, online: <http://www.northwestflyfishingadventures.com/wheelassyal.html>, accessed: Apr. 6, 2006, pp. 1-2.

TubeDude Moderator, online: <http://www.bigfishtackle.com/forum/Float_Tubing_C66/Float_Tubing_General_F81/Need . . . >, accessed: Jan. 17, 2006, p. 1.

Buck's Bags Inc., online: <http://www.bucksbags.com/cm_item.asp?id=177>, accessed: Apr. 6, 2006, p. 1.

Oregon Fishing, Water Skeeter, online: <http://www.oregonfishing.com/detail.aspx?ID=509>, accessed: Apr. 6, 2006, p. 1.

Pontoon Caddy, online: <http://cgi.ebay.com/Kick-Boat-Wheel-Pontoon-Caddy-Boat-Caddy-NEW-NR_W0QQitemZ . . . >, accessed: Apr. 6, 2006, p. 1.

(Continued)

*Primary Examiner*—Stephen Avila
(74) *Attorney, Agent, or Firm*—Laurence C. Bonar

(57) ABSTRACT

An apparatus and method for transporting a vessel is provided. The apparatus includes: a base which is attachable to the vessel; and a wheel rotatably mountable to the base such that the apparatus is operable at the wheel to support the vessel substantially midway beneath the vessel when the apparatus is configured in a transport configuration. A pair of parallel, spaced apart cross rails extending between a pair of parallel, spaced apart side bars form a frame of the base. The wheel is mountable between wheel supports attached to the frame. A pair of support arms are slidably and rotatably connected to the cross rails. A support structure is connectable to one of the side bars. The apparatus is collapsible from the transport configuration to a generally planar collapsed configuration. A kit may include the apparatus and attachments for attaching the apparatus to the vessel.

20 Claims, 6 Drawing Sheets

OTHER PUBLICATIONS

Water Skeeter 2006, online: <http://www.waterskeeter.com/>, accessed: Apr. 6, 2006, p. 1.
National Inflatable watercraft, online: <http://www.nationalinflatablewatercraft.com/catalog/item/2980508/2495083>, accessed: Apr. 6, 2006, p. 1.
Oregon Fishing Launching Gear, online: <http://www.oregonfishing.com/detail.aspx?ID=172>, accessed: Apr. 6, 2006, p. 1.
Launching Gear Launching Gear, online: <http://www.launchinggear.com/Launching%20Gear.htm>, accessed May 15, 2006, pp. 1-4.
Launching Gear Sales Flyer, online: <http://www.launchinggear.com/sales_flyer.htm>, accessed: May 15, 2006, pp. 1-6.
Launching Gear Photo Gallery, online: <http://www.launchinggear.com/Photo%20Gallery.htm>, accessed: May 15, 2006, pp. 1-3.

* cited by examiner

APPARATUS AND METHOD FOR TRANSPORTING A VESSEL

BACKGROUND OF THE INVENTION

1. Field of Invention

This invention relates to transportation and, in particular, to an apparatus and method for transporting a vessel.

2. Description of Related Art

Several schemes have been developed for transporting a cargo or load, including transporting a water vessel such as a pontoon boat, canoe, kayak or similar recreational vessel. The vessel may be transported on land to and from a water shore, for example.

Four-wheeled trailers have been used to transport water vessels to a water shore, where the vessel is launched into the water from the trailer. Due to its large size, however, a trailer must remain on shore while the vessel is used in the water. This increases the risk of theft and vandalism of the trailer. Furthermore, the large size of a trailer renders storing the trailer when not in use inconvenient.

Some schemes for transporting a vessel on land include a wheel which remains attached to the vessel when the vessel is in use in the water. Such schemes often place the wheel at least partly underwater during such use, which impedes movement of the vessel in the water, such as by providing drag on vessel movement and undesirably acting as a rudder.

Some schemes in which a wheel remains attached to the vessel when the vessel is in use in the water, place the wheel at an off-center location of the vessel. Structural components attached to the wheel may also be off-center. Such off-center location, however, cause the wheel or a structural component to act as an obstruction when the vessel is being used. For example, the wheel or a structural component may obstruct the installation and operation of a motor attached to the vessel, as motors are typically attached off-center toward one end of the vessel. The off-center wheel or a structural component may impede the entry and exit of a user from the vessel, thereby acting as a tripping hazard for the user. The off-center wheel or a structural component may impede the use of fishing equipment such as a fishing rod, including by posing a hazard for fishing line becoming caught or entangled in the wheel or structural component. The off-center location of the wheel or structural component may also impede or obstruct the use of an anchor.

Some devices that attach to the vessel with one or more wheels placed off-center toward one end of the vessel, require a user to transport the vessel on land by lifting the opposite end of the vessel and carrying the vessel in a wheelbarrow fashion. Lifting and carrying the vessel from one end is an arduous task for the user, and is made more so when gear and equipment is transported with the vessel.

Some schemes employ one or more wheels having a wide tire width, which can impede transport of the vessel in circumstances where the ground is soft, sandy or muddy due to the tendency for mud and dirt to gather and build up in front of the wide wheel as the wheel moves forward. The inconvenience of a wide wheel is exacerbated in cases where the vessel is being pushed in a wheelbarrow fashion by the user and must be pushed through mud.

U.S. Pat. No. 3,671,056 discloses a boat transport device which includes a wheel rigidly attached to a base plate and strap means attached to the base plate for attaching the base plate to a seat board of a boat. When the transport device is attached to the seat board of the boat, the boat can be inverted and directed over land. However, inverting the boat is arduous and the necessity to do so impedes the carrying of gear and equipment in the boat while the boat is being directed over land.

U.S. Pat. No. 3,687,476 discloses a dolly for a boat which includes a single wheel and boat supporting pad means attached to frame means for alignment along the keel of a carried boat. Padded hook means are arranged to fit over a boat's gunwale. However, use of the dolly is limited to boats having keels and a gunwale only.

SUMMARY

The above shortcomings may be addressed by providing, in accordance with one aspect of the invention, an apparatus for transporting a vessel. The apparatus includes: a base, the base being attachable to the vessel; and a wheel rotatably mountable to the base such that the apparatus is operable at the wheel to support the vessel substantially midway beneath the vessel when the apparatus is configured in a transport configuration, whereby the apparatus is collapsible from the transport configuration to a generally planar collapsed configuration.

The base may include a generally planar frame including a pair of parallel, spaced apart cross rails extending between a pair of parallel, spaced apart side bars. The base may further include first and second wheel supports attached to the frame, the wheel being removably mountable to the base between the first and second wheel supports. The first wheel support may include a first wheel support mount for receiving an axle of the wheel, the first wheel support mount being attached to a pair of support arms, each of the support arms being slidably and rotatably connected to a respective one of the cross rails. The first wheel support may further include a pair of sliders, each slider being slidably connected to the respective cross rail, and wherein each support arm is rotatably connected to a respective one of the pair of sliders. The first wheel support mount may include a pair of spaced apart cross rail fasteners for removably fastening the first wheel support mount to the pair of cross rails, thereby fastening the first wheel support when the apparatus is in the collapsed configuration. Each slider may be lockably connected to the respective cross rail. The second wheel support may include a second wheel support mount for receiving an axle of the wheel, the second wheel support mount being attached to a support stub, the support stub being dimensioned for receiving a support strut when the apparatus is in the transport configuration, the support strut being connectable to one of the pair of side bars. The support strut may be rotatably and slidably connected to the one side bar. The support strut may be lockably receivable in the support stub.

A kit for transporting a vessel may include: the apparatus for transporting the vessel, wherein the base is removably attachable to the vessel; and a plurality of clamps for removably clamping the apparatus to the vessel. The kit may also include a plurality of clamping sleeves, each clamping sleeve being dimensioned to fit between a respective one of the clamps and respective portions of the apparatus and of the vessel being clamped by the respective one clamp.

In accordance with another aspect of the invention, there is provided a method of transporting a vessel. The method includes: attaching a base of the apparatus to the vessel; and when the apparatus is in a transport configuration distinct from a generally planar collapsed configuration of the apparatus, supporting the vessel substantially midway beneath the vessel by a wheel rotatably mounted between first and second wheel supports of the base.

The method may further include transforming the apparatus from the collapsed configuration to the transport configuration by slidably extending the first wheel support from a collapsed position of the first wheel support in which the wheel is generally coplanar with a frame of the base to a transport position of the first wheel support in which the wheel is generally perpendicular to the frame; and receiving a support strut of the second wheel support in a support stub of the second wheel support.

The method may further include collapsing the apparatus from the transport configuration to the collapsed configuration by separating the support strut from the support stub; and slidably retracting the first wheel support from the transport position to the collapsed position.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In drawings which illustrate by way of example only embodiments of the invention.

DETAILED DESCRIPTION

An apparatus for transporting a vessel includes: frame means for attaching the apparatus to the vessel; transport means for supporting the vessel substantially midway beneath the vessel when the apparatus is configured in a transport configuration, said transport means being rotatably mountable to said frame means; and collapsing means for collapsing the apparatus to a generally planar collapsed configuration. The collapsing means may include first and second support means for supporting the transport means when mounted to the frame means between the first and second support means. The first support means may be slidably and rotatably connected to the frame means. The second support means may be separatably connectable to the frame means.

Figure 1:
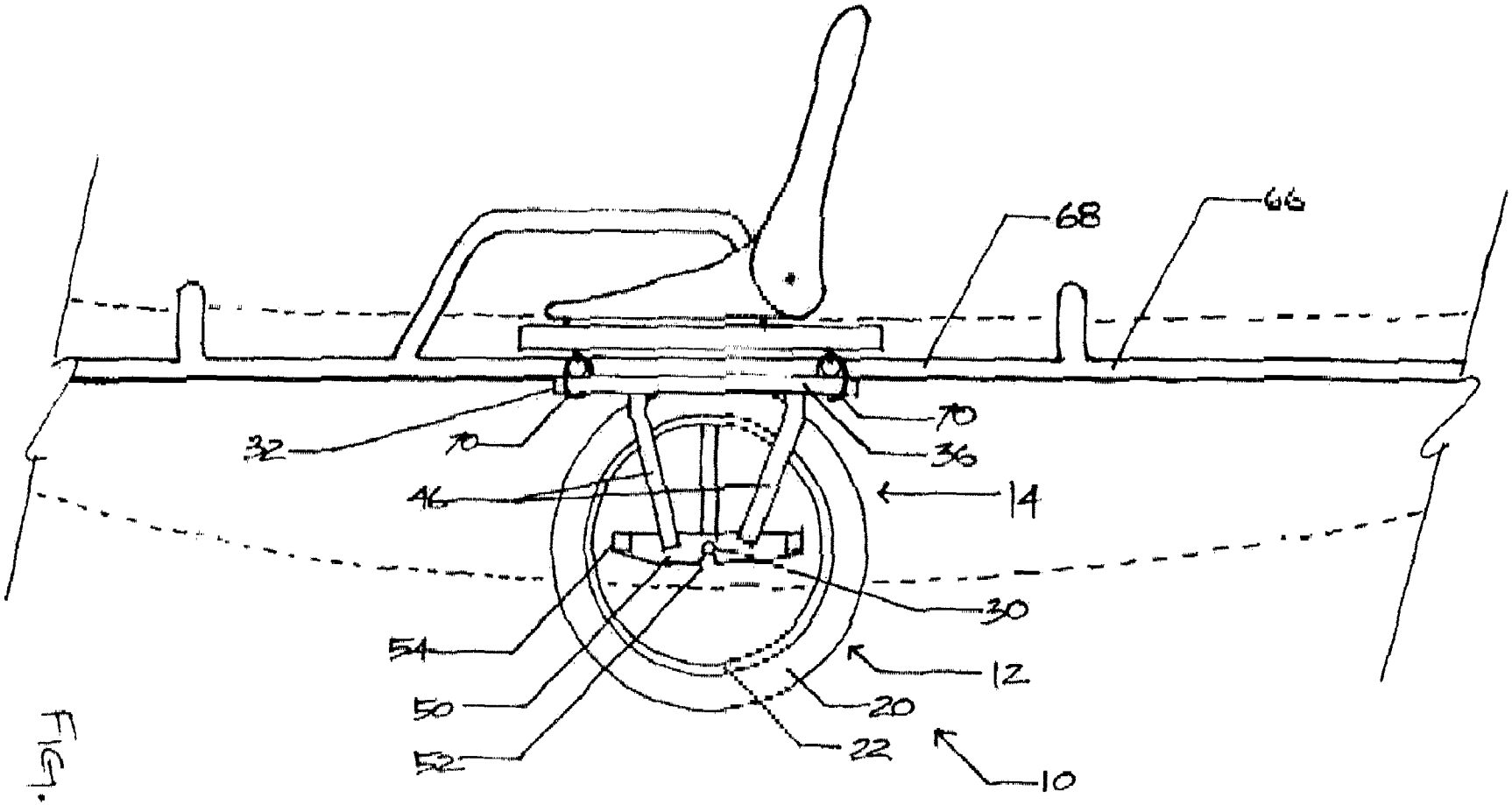
FIG. 1 is a side view of an apparatus for transporting a vessel according to a first embodiment of the invention, shown attached to the vessel and configured in a transport configuration.

Referring to FIG. 1, the apparatus according to a first and preferred embodiment of the invention is shown generally at 10. The apparatus 10 is operable to facilitate the movement or transportation on land of a vessel. The vessel may be any water vessel such as a pontoon boat, canoe, kayak or similar recreational vessel, for example, or more generally may be any cargo or load suitable for wheeled transport. The apparatus 10 may be used to transport the vessel to and from a water shore, for example, when the apparatus 10 is configured in a transport configuration shown in FIG. 1.

Referring to FIGS. 2 to 5, a wheel 12 is shown mounted to a base 14 by a first wheel support 16 and a second wheel support 18 of the base 14. The first wheel support 16 (see particularly FIGS. 2 and 4) is located on the opposite side of the wheel 12 from the second wheel support 18 (see particularly FIGS. 3 and 4). Preferably, the wheel 12 is removably mountable to the base 14 and is operable to rotate. The wheel 12 may be of any suitable style or design.

The wheel 12 may have a tire 20, rim 22, hub 24, spokes 26 attached between the rim 22 and the hub 24, an axle 28 through the hub 24, and wheel lug nuts 30 as is found in standard, commercially available wheels, or may be custom made for mounting at its axle 28 to the base 14. The wheel preferably has a wheel diameter of at least 14 inches, and the first embodiment preferably includes a wheel having wheel diameter between 16 and 20 inches. The tire 20 width is preferably equal to or less than fifteen percent of the diameter of the wheel 12, and may be between 1 and 3 inches.

The base 14 includes in the first embodiment a frame 32 which includes a pair of parallel, spaced apart cross rails 34 that extend between a pair of parallel, spaced apart side bars 36. In the first embodiment, the frame 32 is generally planar and quadrilateral in shape. Preferably, the side bars 36 extend past their points of intersection with the cross rails 34. The frame 32 is preferably formed from hollow lengths of pipes or tubing that are joined at connection points, including being joined by welding, riveting, otherwise fastened, such as being removably fastened by fasteners (e.g. pins, screws or bolts), or combinations thereof, for example. Alternatively, the tubing may be continuous tubing that is bent and may be welded at reinforcement points. The cross-sectional shape of the frame 32 tubing is shown in the figures as round, but may have any suitable shape, including square, quadrilateral, triangular, polygonal, elliptical. The frame 32 is preferably made of a strong and lightweight rust-resistant material. For example, the frame 32 may be made of aluminum, stainless steel, plastic, composite material, or one or more similarly suitable materials.

The first wheel support 16 of the base 14 includes a pair of sliders 38 in which one slider 38 is mounted onto each cross rail 34 so as to be able to slide along at least a portion of the length of the cross rail 34 and, preferably, along substantially the whole length of the cross rail 34.

Figure 2:
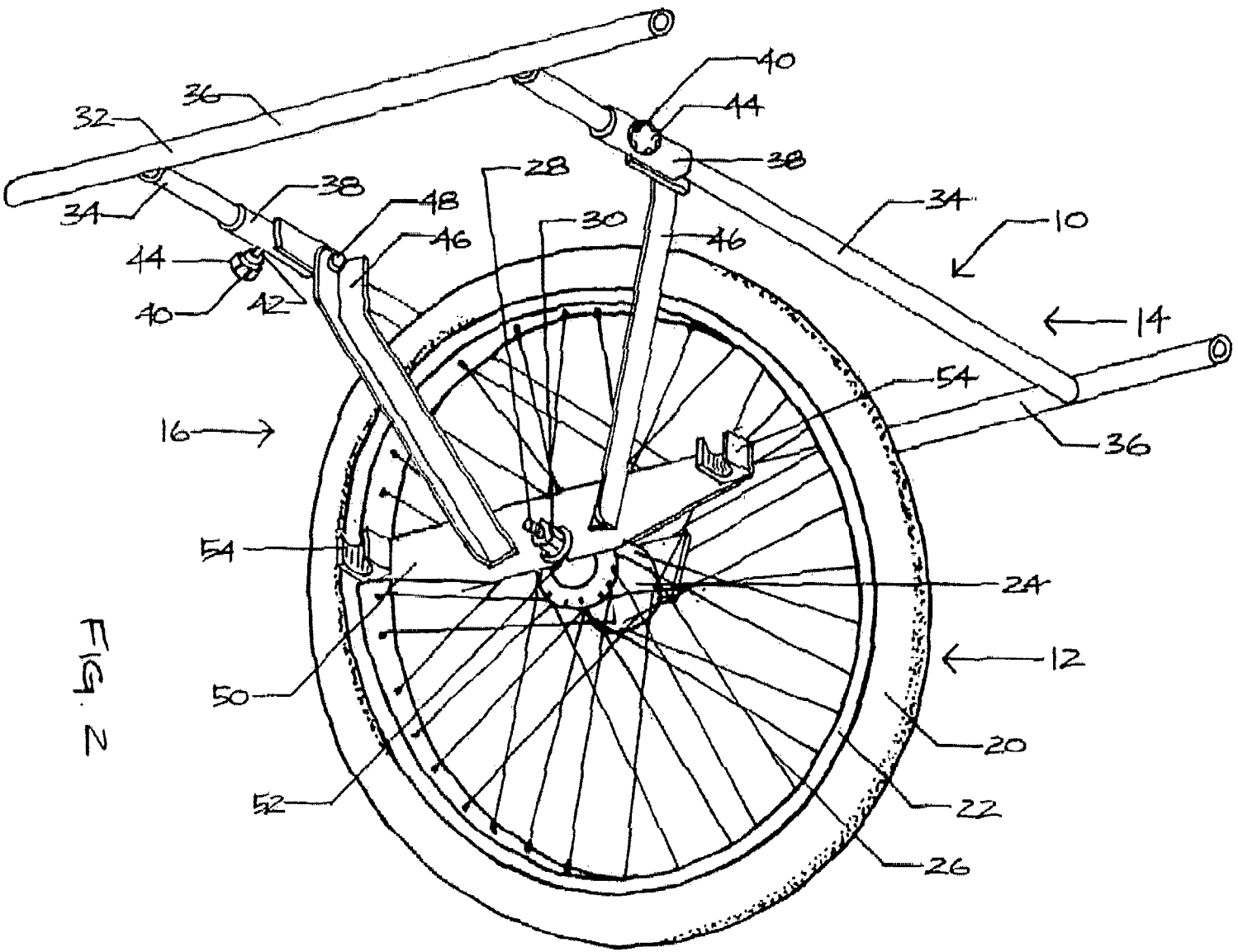
FIG. 2 is a perspective view of the apparatus shown in FIG. 1, showing a first wheel support.

In the first embodiment, each slider 38 can be locked in place at a desired position along the cross rail 34 by a slider lock 40 (see particularly FIG. 2). The slider lock 40 preferably includes a threaded rod 42 threadedly engaged to the slider 38 and projecting therefrom to a lock rod handle 44 for rotating the threaded rod 42 within the slider 38. The threaded rod 42 may be rotated until its end (not shown) opposite the handle 44 abuts and tightens against the cross rail 34 so as to lock the slider 38 to the cross rail 34. Alternatively, other suitable methods and means for lockably connecting the slider 38 to the cross rail 34 may be employed.

The first wheel support 16 includes a pair of support arms 46 preferably slidably and rotatably connected to the cross rails 34. Each slider 38 is preferably rotatably connected to one support arm 46. In the first embodiment, a hinge pin 48 (FIG. 2) operates to connect each support arm 46 to its connected slider 38. However, other methods, means or techniques could be employed to cause the support arms 46 to rotate relative to the cross rails 34 as the sliders 38 are slid along the cross rails 34.

The respective ends of the support arms 46 opposite the sliders 38 are preferably attached to a first wheel support mount such as the elongated mounting plate 50 shown in FIG. 2. The support arms 46 and the elongated mounting plate 50 may be attached by welding, riveting, fastening or combinations thereof, for example. The elongated mounting plate 50 includes a hole or recess 52 dimensioned for receiving one end of the axle 28 of the wheel 12. One lug nut 30 may be used to fasten the wheel 12 to the elongated mounting plate 50 when the axle 28 end is placed within the recess 52.

At opposing ends of the elongated mounting plate 50, each of a pair of cross rail fasteners, such as the gripping clips 54 shown in FIG. 2, are attached to the elongated mounting plate 50. The gripping clips 54 operate to fasten the first wheel support 16 to the cross rails 34 as described further below. Each gripping clip 54 preferably includes a pair of spaced apart curvilinear projections which are resiliently urged toward each other when a cross rail 34 is placed between the pair of projections, thereby causing the gripping clip 54 to grip the cross rail 34. Other fastening techniques may be used, however, to removably attach the first wheel support 16 to the cross rail 34. The gripping clips 54 may be attached to the elongated mounting plate 50 by riveting, clipping or otherwise fastening, adhering, or combinations thereof, for example. The material of the gripping clips 54, including their projections, may be an elastic or elastomeric material such as rubber, plastic, metal, including metal shaped into resilient forms, or combinations thereof, for example.

Figure 3:
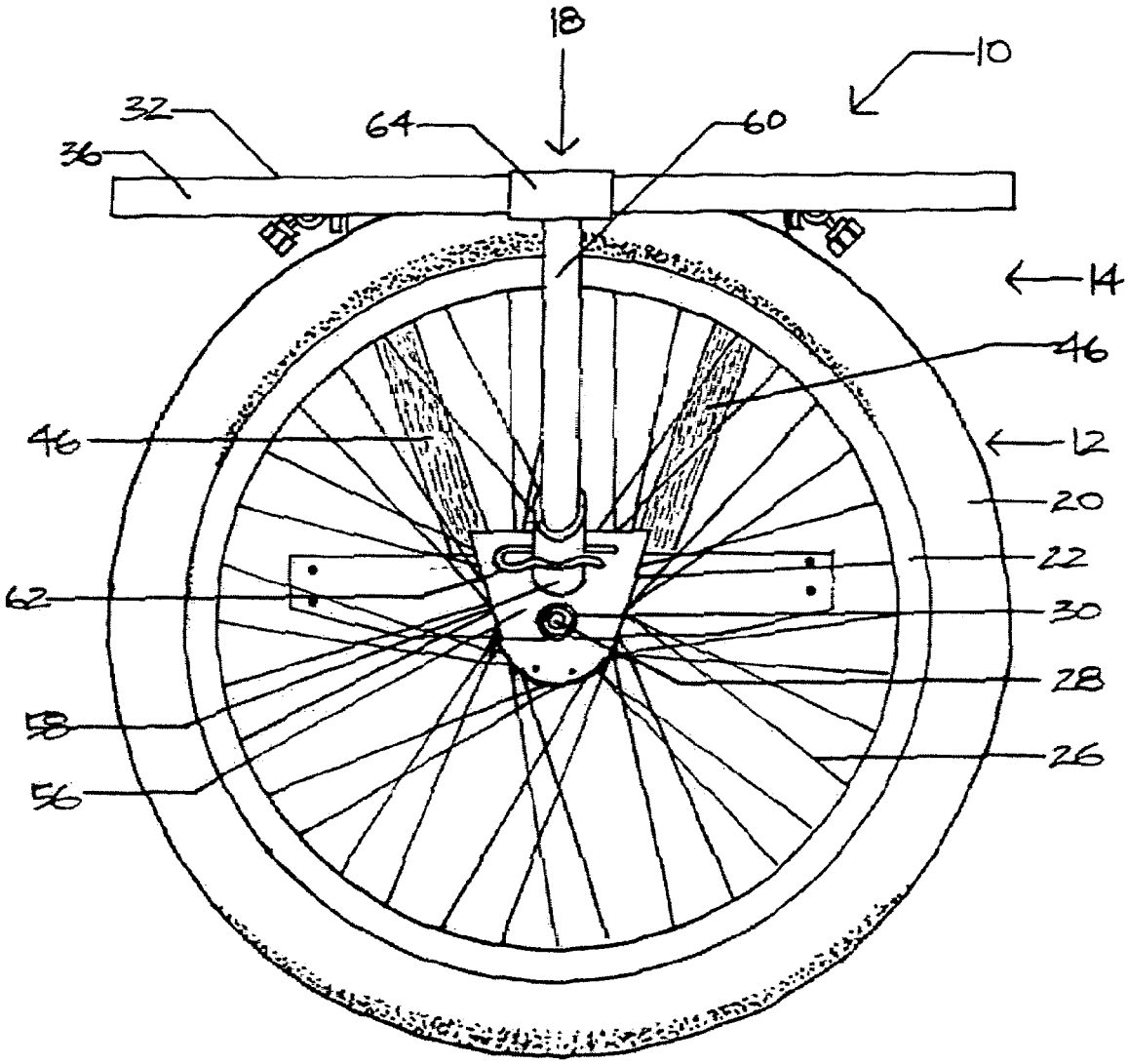
FIG. 3 is a side view of the apparatus shown in FIG. 1, showing a second wheel support.
Figure 4:
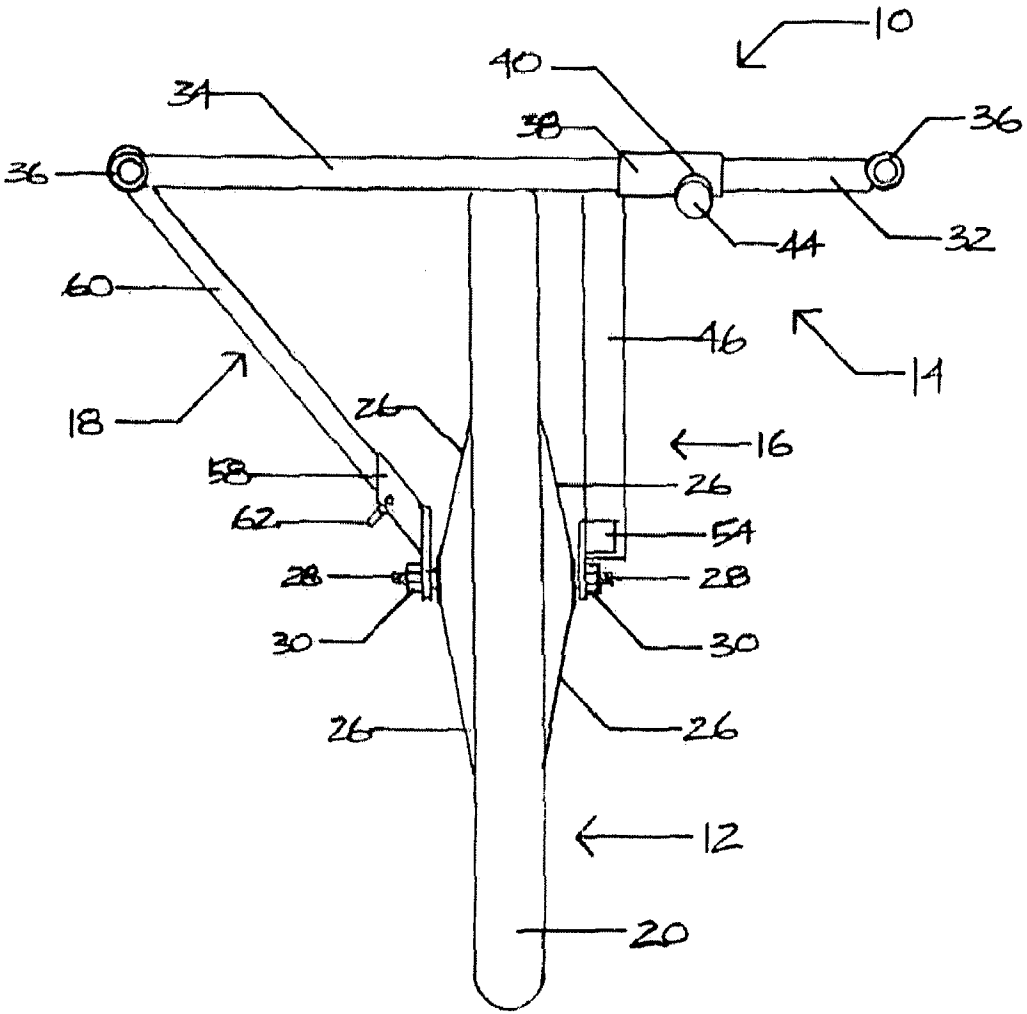
FIG. 4 is a front or rear view of the apparatus shown in FIG. 1, showing the first and second wheel supports on opposing sides of a wheel.

FIGS. 3 and 4 show the second wheel support 18 located on the opposite side of the wheel 12 from the first wheel support 16 (FIGS. 2 and 4). The second wheel support 18 includes a second wheel support mount such as the short mounting plate 56 shown in FIG. 3. While the short mounting plate 56 is referenced using the term "short", the short mounting plate 56 may be of any size suitable for receiving one end of the axle 28 of the wheel 12 and for having attached thereto a support structure connecting the short mounting plate 56 to the frame 32. The dimensions of the short mounting plate 56 should not exceed those of the tire 20 or interfere with rotation of the wheel 12.

In the first embodiment, the short mounting plate 56 is connected to the frame 28 via a support stub 58 removably attachable to a support strut 60, as shown in FIGS. 3 and 4. The support stub 58 may be attached to the short mounting plate 56 by welding, fastening, including fastening by fasteners such as pins, rivets, screws or bolts, or combinations thereof, for example. The support stub 58 is preferably formed from hollow tubing dimensioned to receive therein a free end of the support strut 60. The support strut 60 may also be formed from hollow tubing, although need not be. The outer dimensions of the free end of the support strut 60 and the inner dimensions of the support stub 58 where the support strut 60 free end is received preferably have complementary cross-sectional dimensions. The cross-sections of the support stub 58 and the support strut 60 free end may be circular, as shown in FIG. 3, or may be any other shape, including square, rectangular, polygonal, elliptical, curvilinear, or combinations thereof, for example.

The support strut 60 and support stub 58 are preferably removably attachable and the support strut 60 lockably receivable in the support stub 58. In the first embodiment, a locking member such as the pin clip 62 shown in FIG. 3 may be used to secure the support strut 60 to the support stub 58. Apertures (not all shown) in opposing sides of the support stub 58 and the support strut 60 are positioned to align when the support strut 60 free end is received within the support stub 58. The pin clip 62 can be inserted through the aligned apertures, thereby securing the support strut 60 to the support stub 58. Other techniques for lockably receiving the support strut 60 within the support stub 58 may also be used. The respective lengths of the support stub 58 and the support strut 60 may be correspondingly varied so as to locate the mating portions thereof anywhere along the support structure connecting the short mounting plate 56 to the frame 28.

In the first embodiment, the support strut 60 is rotatably connected to the side bar 36 which is adjacent the second wheel support 18. The support strut 60 may also be slidably connected to the side bar 36, including being operable to slide along substantially the entire length of the portion of the side bar 36 between the cross rails 34. With reference to FIG. 3, the attached end of the support strut 60 rotatably and slidably attached to the side bar 36 is formed from a hollow tubular section 64 surrounding the side bar 36 and having inner cross-sectional dimensions complementary, including being slightly larger, to the outer cross-sectional dimensions of the side bar 36. By this or similar technique, the support strut 60 can rotate about the side bar 36 and slide along the side bar 36 when the support strut 60 is separated from the support stub 58. The tubular section 64 and the side bar 36 to which the tubular section 64 is attached preferably have circular cross-sectional shapes.

Different components of the base 14, including the frame 32 and the first and second wheel supports 16 and 18, may be made of similar or different materials.

Figure 5:
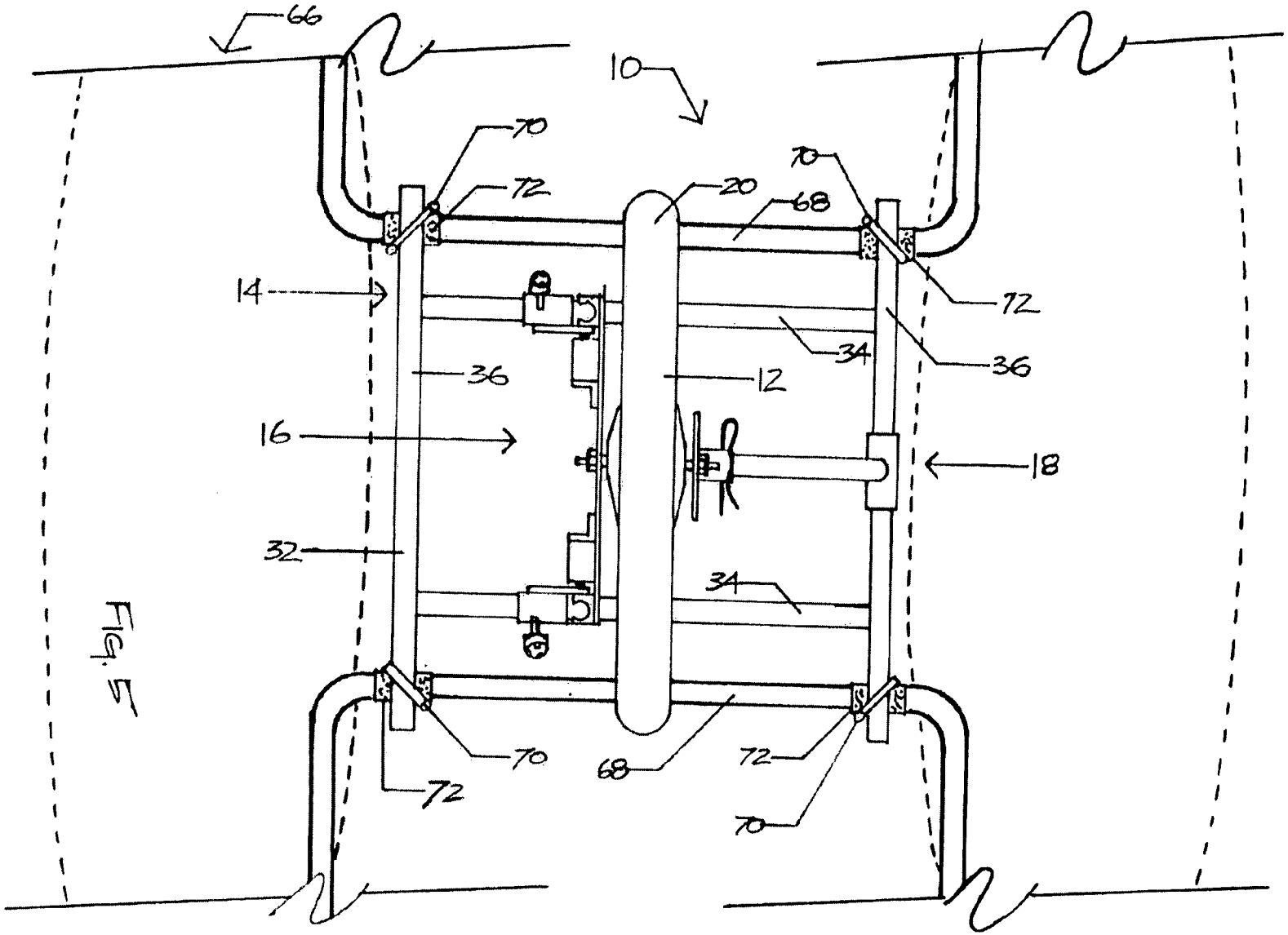
FIG. 5 is a bottom view of the apparatus shown in FIG. 1, shown attached to the vessel and configured in a transport configuration.

Referring to FIG. 5, the apparatus 10 may be attached to a vessel such as a pontoon boat 66, a portion of which is shown in FIG. 5. By way of example, the base 14 may be removably attachable to a pair of spaced apart frame members 68 of the pontoon boat 66 by use of clamps 70. Each clamp 70 is preferably an adjustable clamp adapted to tighten the ends of the side bars 36 extending beyond the cross rails 34 against the frame members 68. Each clamp 70 is preferably a stainless steel band clamp, but may also be a U-bolt, bar clamp, spring clamp, tie-wrap or other fastener, for example. Methods or techniques for removably or permanently attaching the base 14 to the vessel may include welding; press fitting; interfitting; interlocking; hooking; fastening, including riveting, screwing or bolting; tying, including tying by rope or cable; or combinations thereof, for example.

Clamping sleeves 72 may be advantageously used to prevent the apparatus 10 or the vessel from being scratched, scarred, scored or otherwise marked, including at portions thereof where the apparatus 10 is attached to the vessel. Each clamping sleeve 72 may be made of any material having a non-abrasive surface such as rubber, plastic, fabric, foam, composite material, or combinations thereof, for example. Each clamping sleeve 72 may be made of a resilient material or include a resilient layer, such as an outer layer of rubber or foam for example.

As shown in FIG. 5, each clamping sleeve 72 is preferably dimensioned to suitably fit between the clamp 70 and the clamped portions of the apparatus 10 and of the vessel.

A kit may include the apparatus 10 and attachment means for attaching the apparatus 10 to the vessel. The kit may include one or more clamps 70 and preferably includes at least two clamps 70. The arrangement shown in FIG. 5 shows the use of four clamps 70 at four corners of the apparatus 10. The kit may also include one or more clamping sleeves 72 and preferably includes at least one clamping sleeve 72 for each clamp 70 provided in the kit. Alternatively, the kit may include only the attachment means for use with the apparatus 10, which may be separately provided. The kit may also include instructions on the use of the attachment means.

Collapsibility

Figure 6:
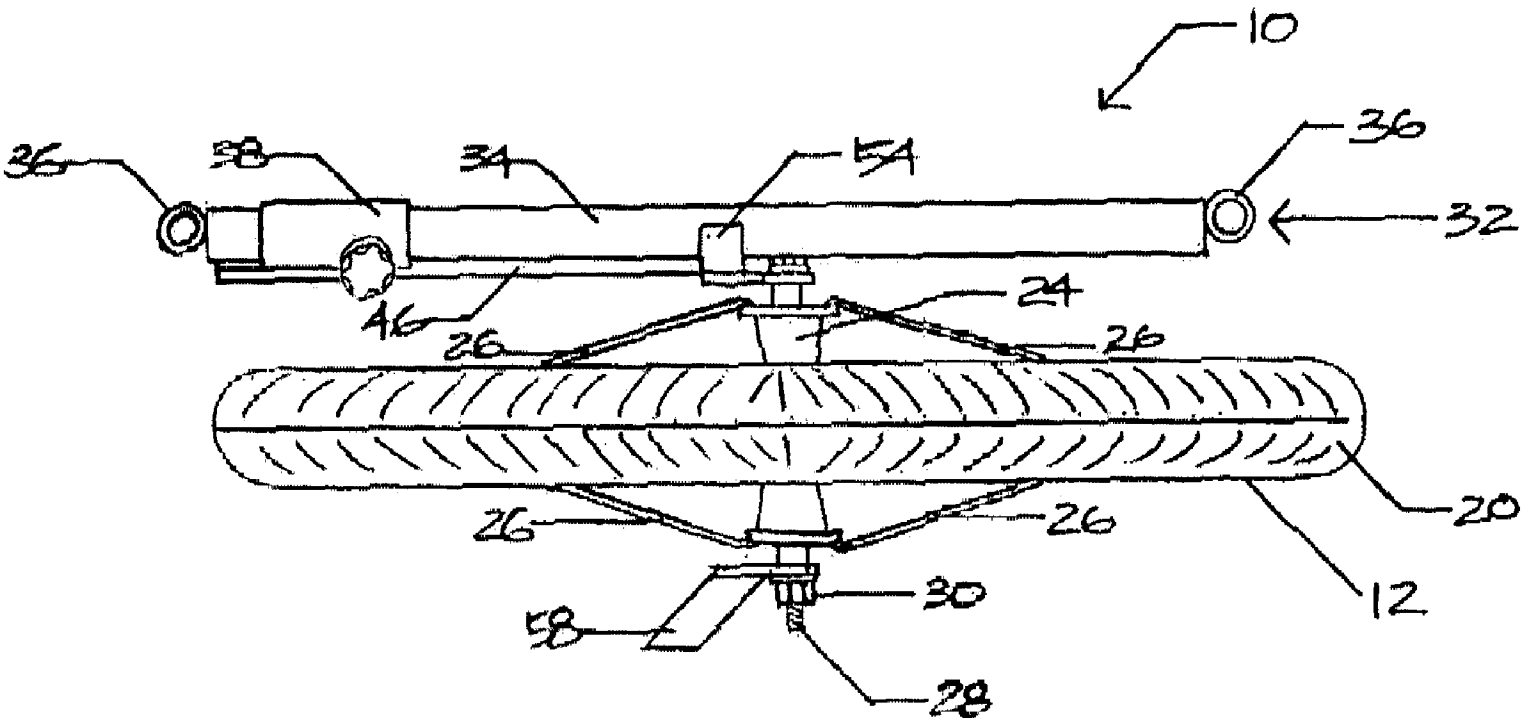
FIG. 6 is a side view of the apparatus shown in FIG. 1, showing the apparatus in a collapsed configuration.

Referring to FIG. 6, the apparatus 10 may be collapsed from its transport configuration shown in FIGS. 1 to 5 to a collapsed configuration as shown in FIG. 6. The wheel 12 is generally coplanar with the frame 32 when the first wheel support 16 is in a collapsed position and the apparatus 10 is in the collapsed configuration (FIG. 6). When the wheel 12 is generally perpendicular to the frame 32, the first wheel support 16 is in a transport position and the apparatus 10 is in the transport configuration (FIGS. 1 to 5).

To collapse the apparatus 10, the connection of the second wheel support 18 is separated and the first wheel support 16 is slidably retracted from its transport position to its collapsed position. In the first embodiment, the connection of the second wheel support 18 may be separated by removing the pin clip 62 from the apertures of the support stub 58 and the support strut 60 and then pulling the free end of the support strut 60 out and away from the support stub 58. Before or after separating the connection of the second wheel support 18, the slider locks 40 may be disengaged to unlock the sliders 38 from the cross rail 34.

When the connection of the second wheel support 18 has been separated and the slider locks 40 are disengaged, the first wheel support 16 may be brought into a coplanar relationship with the frame 32, thereby collapsing the apparatus 10. Such coplanar relationship may be achieved by slidably retracting the first wheel support 16 from its transport position to its collapsed position. In the first embodiment, sliding the sliders 38 along the cross rails 34 while rotating the support arms 46 toward the frame 32 slidably retracts the first wheel support 16.

The support strut 60 may be advantageously rotated and/or slid relative to the side bar 36 to provide adequate clearance for the wheel support 16 when transforming the apparatus 10 between its transport and collapsed configurations. For example, the support strut 60 may be placed substantially coplanar and within the general confines of the frame 32, thereby advantageously reducing the overall dimensions of the apparatus 10 when in the collapsed configuration.

When the apparatus 10 is in the collapsed configuration, the first wheel support 16 may be fastened, including by engaging the gripping clips 54 to the cross rails 34. Also, the slider locks 40 may be engaged so as to lock the sliders 38 in place.

To transform the apparatus 10 from its collapsed configuration (FIG. 6) to its transport configuration (FIGS. 1 to 5), the first wheel support 16 may be slidably extended from its collapsed position to its transport position and the connection of the second wheel support 18 may be established. To do so, the slider locks 40 and the gripping clips 54 should be disengaged. In the first embodiment, sliding the sliders 38 along the cross rails 34 while rotating the support arms 46 away from the frame 32 slidably extends the first wheel support 16. The first wheel support 16 may be slidably extended until the wheel 12 is generally perpendicular to the frame 32, as shown in FIGS. 1 to 5. When the first wheel support 16 in its transport position or nearly in its transport position, the connection of the second wheel support 18 may be established so as to fully bring the apparatus 10 to its transport configuration. In the first embodiment, the second wheel support 18 connection may be established by inserting the free end of the support strut 60 into the support stub 58 until an alignment permitting the insertion of the pin clip 62 is achieved. Inserting the pin clip 62 locks the connection of the second wheel support 18.

Thus, there is provided an apparatus for transporting a vessel, the apparatus comprising: a base, said base being attachable to the vessel; and a wheel rotatably mountable to said base such that the apparatus is operable at said wheel to support the vessel substantially midway beneath the vessel when the apparatus is configured in a transport configuration, whereby the apparatus is collapsible from said transport configuration to a generally planar collapsed configuration.

Operation

By way of example, the apparatus 10 may be attached to a vessel such as the pontoon boat 66 shown in FIGS. 1 and 5. The apparatus 10 is advantageously dimensioned to fittably attach to a plurality of commercially available models of pontoon boats 66 and other vessels. The apparatus 10 may be placed in the transport or collapsed configuration while the vessel and attached apparatus 10 are transported by motor vehicle to a location near a water shore. The vessel and attached apparatus 10 may then be removed from the motor vehicle. When the apparatus 10 is in the transport configuration, the apparatus 10 advantageously facilitates transport of the upright vessel and associated gear and equipment, if any, from the motor vehicle to the water shore.

The wheel 12 may be advantageously dimensioned for transporting the vessel over rough, soft, sandy and/or muddy terrain as is often encountered near a water shore. For example, the wheel 12 diameter may be large relative to the size of typical obstacles and the tire 20 width may be optimally selected, including selecting the tire 20 width relative to the tire 20 diameter to avoid unnecessary sinking due to an overly narrow tire 20 and unnecessary plowing due to an overly wide tire 20.

At or near the water shore, the vessel may be upended on one end thereof, thereby exposing the apparatus 10 to facilitate collapsing the apparatus 10. When the apparatus 10 is in its collapsed configuration, the vessel may then be returned to its normal upright position and introduced onto the water surface. Alternatively, the apparatus 10 may be collapsed while the vessel floats on the surface of the water. The collapsed configuration of the apparatus 10 advantageously avoids impeding the operation and use of the vessel.

While specific embodiments of the invention have been described and illustrated, such embodiments should be considered illustrative of the invention only. The invention may include variants not described or illustrated herein in detail. For example, one or more portions of the support structure of the second wheel support, such as the support strut, may be removably connectable to the frame of the described apparatus. Thus, the embodiments described and illustrated herein should not be considered to limit the invention as construed in accordance with the accompanying claims.

REFERENCE CHARACTERS for APPARATUS AND METHOD FOR TRANSPORTING A VESSEL

10 apparatus
12 wheel
14 base
16 first wheel support
18 second wheel support
20 tire
22 rim
24 hub
26 spokes
28 axle
30 lug nut
32 frame
34 cross rail
36 side bar
38 slider
40 slider lock
42 threaded rod

44 handle
46 support arm
48 hinge pin
50 elongated mounting plate
52 recess
54 gripping clip
56 short mounting plate
58 support stub
60 support strut
62 pin clip
64 tubular section
66 pontoon boat
68 frame member
70 clamp
72 clamping sleeve

What is claimed is:

1. An apparatus for transporting a vessel, the apparatus comprising:

(a) a base comprising a substantially planar frame having at least one cross rail extending laterally across said frame, said base being attachable to the vessel;

(b) a first wheel support hingedly mounted to said frame;

(c) at least one slider being slidably connectable to said at least one cross rail and wherein said first wheel support is hingedly connected to said slider; and (d) a wheel rotatably mountable to said first wheel support;

such that said first wheel support and said wheel are slidably and hingedly movable in a lateral direction with respect to said frame between a first transport configuration wherein said wheel support and said wheel are oriented substantially perpendicular to said frame, and a second collapsed configuration wherein said wheel support and said wheel are oriented substantially parallel to and coplanar with said frame; and wherein when said base is attached to the vessel and the apparatus is configured in said first transport configuration, the apparatus is operable at said wheel to support the vessel substantially midway laterally beneath the underside of the vessel, and said first wheel support and said at least one slider are situated beneath the underside of the vessel and are slidably and hingedly movable within a lateral range of motion beneath the underside of the vessel.

2. The apparatus of claim 1, wherein said frame comprises a pair of parallel, spaced apart cross rails extending between a pair of parallel, spaced apart side bars.

3. The apparatus of claim 2, wherein said base further comprises a second wheel support attached to said frame, said wheel being removably mountable between said first and second wheel supports.

4. The apparatus of claim 3, wherein said first wheel support comprises a first wheel support mount for receiving an axle of said wheel, said first wheel support mount being attached to a pair of support arms, each of said support arms being slidably and hingedly connected to a respective one of said cross rails.

5. The apparatus of claim 4, wherein said first wheel support further comprises a pair of sliders, each said slider being slidably connected to said respective cross rail, and wherein said each support arm is hingedly connected to a respective one of said pair of sliders.

6. The apparatus of claim 5, wherein said first wheel support mount comprises a pair of spaced apart cross rail fasteners for removably fastening said first wheel support mount to said pair of cross rails, thereby fastening said first wheel support when the apparatus is in said collapsed configuration.

7. The apparatus of claim 6, wherein said each slider is lockably connected to said respective cross rail.

8. The apparatus of claim 3, wherein said second wheel support comprises a second wheel support mount for receiving an axle of said wheel, said second wheel support mount being attached to a support stub, said support stub being dimensioned for receiving a support strut when the apparatus is in said transport configuration, said support strut being connectable to one of said pair of side bars.

9. The apparatus of claim 8, wherein said support strut is hingedly and slidably connected to said one side bar.

10. The apparatus of claim 9, wherein said support strut is lockably receivable in said support stub.

11. The apparatus of claim 5, wherein said second wheel support comprises a second wheel support mount for receiving said axle of said wheel, said second wheel support mount being attached to a support stub, said support stub being dimensioned for receiving a support strut when the apparatus is in said transport configuration, said support strut being connectable to one of said pair of side bars.

12. The apparatus of claim 11, wherein said support strut is hingedly connected to said one side bar.

13. The apparatus of claim 12, wherein said support strut is lockably receivable in said support stub.

14. A kit for transporting a vessel, the kit comprising:

(a) the apparatus of claim 1, wherein said base is removably attachable to the vessel; and (b) a plurality of clamps for removably clamping the apparatus to the vessel.

15. The kit of claim 14, further comprising a plurality of clamping sleeves, each said clamping sleeve being dimensioned to fit between a respective one of said clamps and respective portions of the apparatus and of the vessel being clamped by said respective one clamp.

16. A method of transporting a vessel, the method comprising:

(a) attaching the base of the apparatus of claim 1 to the vessel; and (b) when the apparatus is in said first transport configuration distinct from said second collapsed configuration of the apparatus, supporting the vessel substantially midway laterally beneath the underside of the vessel by said wheel.

17. The method of claim 16, further comprising transforming the apparatus from said collapsed configuration to said transport configuration by (i) slidably extending said first wheel support from a collapsed position of said first wheel support in which said wheel is substantially parallel to and coplanar with said frame of said base to a transport position of said first wheel support in which said wheel is substantially perpendicular to said frame; and (ii) receiving a support strut of a second wheel support hingedly mounted to said frame in a support stub of said second wheel support.

18. The method of claim 17, further comprising collapsing the apparatus from said transport configuration to said collapsed configuration by (i) separating said support strut from said support stub; and (ii) slidably retracting said first wheel support from said transport position to said collapsed position.

19. An apparatus for transporting a vessel, the apparatus comprising:

(a) frame means for attaching the apparatus to the vessel comprising at least one cross rail means extending laterally across said frame means; and (b) transport means for supporting the vessel substantially midway laterally beneath the underside of the vessel when the apparatus is configured in a transport configuration, said transport means comprising a wheel being rotatably mountable to said frame means and being oriented substantially perpendicular to said frame means when the apparatus is configured in said transport configuration; and (c) collapsing means for collapsing the apparatus to a substantially planar collapsed configuration, said collapsing means comprising a first support means and a slider means, said first support means being hingedly and laterally slidably connected to said cross rail means by said slider means and being rotatably mountable to said transport means, said collapsing means and said transport means being oriented substantially parallel to and coplanar with said frame means when the apparatus is configured in said collapsed configuration, and being oriented substantially perpendicular to said frame means when the apparatus is configured in said transport configuration, wherein said first support means and said slider means are situated beneath the underside of the vessel and are slidably and hingedly movable within a lateral range of motion beneath the underside of the vessel when the apparatus is attached to the vessel.

20. The apparatus of claim 19, wherein said collapsing means additionally comprises a second support means for supporting said transport means when mounted between said first and second support means to said frame means, said first support means being slidably and hingedly connected to said frame means, said second support means being separatably connectable to said frame means.

* * * * *